US006762387B2

(12) United States Patent
Kawamoto et al.

(10) Patent No.: US 6,762,387 B2
(45) **Date of Patent: *Jul. 13, 2004**

(54) GAS-INSULATED SWITCH

(75) Inventors: Hideo Kawamoto, Hitachi (JP); Kenichi Okubo, Hitachi (JP); Tetsu Ishiguro, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/424,716

(22) Filed: Apr. 29, 2003

(65) Prior Publication Data

US 2003/0201250 A1 Oct. 30, 2003

Related U.S. Application Data

(63) Continuation of application No. 10/117,126, filed on Apr. 8, 2002.

(30) Foreign Application Priority Data

Jul. 23, 2001 (JP) ..... 2001-220822

(51) Int. Cl.[7] ..... H01H 33/04
(52) U.S. Cl. ..... 218/84; 218/78
(58) Field of Search ..... 218/84, 78, 14–20, 218/45, 50, 120, 140, 153, 154

(56) References Cited

U.S. PATENT DOCUMENTS

| | | | | | |
|---|---|---|---|---|---|
| 3,639,713 | A | * | 2/1972 | Fischer et al. | 218/84 |
| 3,932,719 | A | * | 1/1976 | Goodwin et al. | 218/78 |
| 4,027,125 | A | * | 5/1977 | Peek et al. | 218/44 |
| 4,029,923 | A | * | 6/1977 | Meyer et al. | 200/253.1 |
| 4,096,367 | A | * | 6/1978 | Peek et al. | 218/78 |
| 5,298,704 | A | * | 3/1994 | Opfer et al. | 218/84 |

* cited by examiner

*Primary Examiner*—Karl D. Easthom
*Assistant Examiner*—M. Fishman
(74) *Attorney, Agent, or Firm*—Mattingly, Stranger & Malur, P.C.

(57) ABSTRACT

A gas-insulated switch equipped with a fixed contact and a moving contact that can contact with and separate from the fixed contact, wherein a single shock absorber absorbs the shock in both the breaking action and the closing action of the moving contact.

2 Claims, 5 Drawing Sheets

GAS-INSULATED SWITCH

This is a continuation application of U.S. Ser. No. 10/117,126, filed Apr. 8, 2002.

BACKGROUND OF THE INVENTION

1. Field of the Invention

The present invention relates to a gas-insulated switch, particularly to a gas-insulated switch with a function of braking the inertial mass speed of the moving contact.

2. Prior Art

Generally, a gas-insulated switch is equipped with a fixed contact and a moving contact for closing and breaking the main circuit of the power line so as to turn on and off the electricity. To break the main circuit, a break signal is sent to the operating device that drives the moving contact. Similarly, to connect the main line electrically, a close signal is sent to the operating device.

As shown in FIG. 5, the moving portion of the switch, including the moving contact constituting the main circuit, makes accelerated motion and uniform motion, defined by the relationship among the drive force, load force and friction force, in the closing and breaking actions. At the last moment of each closing and breaking action, a suitable breakage is needed so as to prevent the switch from mechanical damage. According to a prior art, for example as disclosed in the Japanese Application Patent Laid-Open Publication No. Hei 10-228847 (hereinafter called the prior example 1), a dashpot is provided in the shock absorber of the operating device so as to perform a suitable breakage and absorb the shock in each closing and breaking action.

According to the Japanese Application Patent Laid-Open Publication No. Hei 11-213824 (hereinafter called the prior example 2), two dampers are used as shock absorber at the last moment of each closing and breaking action and the shock in each closing and breaking action is absorbed as the lever contacts the dampers.

When the switch shown in the prior example 1 is employed, part of the drive energy of the operating device is consumed since the shock absorber itself works as a load all the time in the closing and breaking actions of the gas-insulated switch. Because of this, all energy of the drive source of the operating device is not converted into the accelerated motion and uniform motion of the moving contact, hence resulting in a disadvantage of poor energy efficiency.

When the switch shown in the prior example 2 is employed, the energy efficiency improves but a shock absorber needs to be provided individually for a closing operation and for a breaking operation, still resulting in a disadvantage that the outside dimension and the number of parts of the operating device increase. For the above reasons, when an operating device utilizing a shock absorber of the prior art is employed for a gas-insulated switch, there arises a problem that the space needed for a power station and substation increases because the component size increases and that a social need such as improvement of the economy cannot be met because the energy loss of the drive source of the operating device is high.

SUMMARY OF THE INVENTION

An object of the present invention is to provide a gas-insulated switch wherein the energy needed to cause the moving parts to make accelerated motion and uniform motion can be lowered.

Another object of the present invention is to provide a gas-insulated switch wherein the specification requirement of a component such as a spring, pneumatic cylinder, or hydraulic cylinder, serving as the energy source of the operating device itself, used in the gas-insulated switch can be lowered.

A further object of the present invention is to provide a gas-insulated switch wherein the size of the operating device itself for driving the gas-insulated switch and the overall size of the gas-insulated switch can be reduced.

A further object of the present invention is to provide a gas-insulated switch wherein the necessary shock absorbers can be constructed into a single unit and a further reduction of the size of the operating device can be attained.

A further object of the present invention is to provide a gas-insulated switch wherein the offering a gas-insulated switch that sufficiently meets the social needs such as effective utilization of the space of a power station or substation and improvement of the economy can be realized.

To solve the above-mentioned problems, the gas-insulated switch according to the present invention is equipped with a shock absorber for absorbing the shock on the fixed and moving contacts in the closing and breaking operations of the operating device, the shock absorber is installed in the breaking operation section of the operating device, and the shock is absorbed by this shock absorber in both closing and breaking operations.

Besides, to solve the above-mentioned problems, the gas-insulated switch according to the present invention is equipped with a shock absorber for absorbing the shock on the fixed and moving contacts in the closing and breaking operations of the operating device, the shock absorber is installed in the breaking operation section of the operating device, and the shock is absorbed by this shock absorber in both closing and breaking operations.

Besides, to solve the above-mentioned problems, the gas-insulated switch according to the present invention is equipped with a shock absorber for hydraulically absorbing the shock on the fixed and moving contacts in the closing and breaking operations of the operating device, the shock absorber adjusts the shock in the closing and breaking operations by adjusting the hydraulic pressure, and the shock is absorbed by this shock absorber in both closing and breaking operations.

Besides, to solve the above-mentioned problems, the gas-insulated switch according to the present invention is equipped with a shock absorber that brakes the moving contact in the breaking action and closing action of the moving contact and an output lever that is linked with the moving contact, and the shock absorber is installed at a position in either of the moving directions of the output lever.

BRIEF DESCRIPTION OF THE DRAWINGS

FIG. 4(*b*) is a view along line A—A of FIG. 3 showing the shock absorber in the course of being mounted;

DESCRIPTION OF THE INVENTION

A preferred embodiment of the gas-insulated switch according to the present invention is explained hereunder, using figures.

Figure 6:
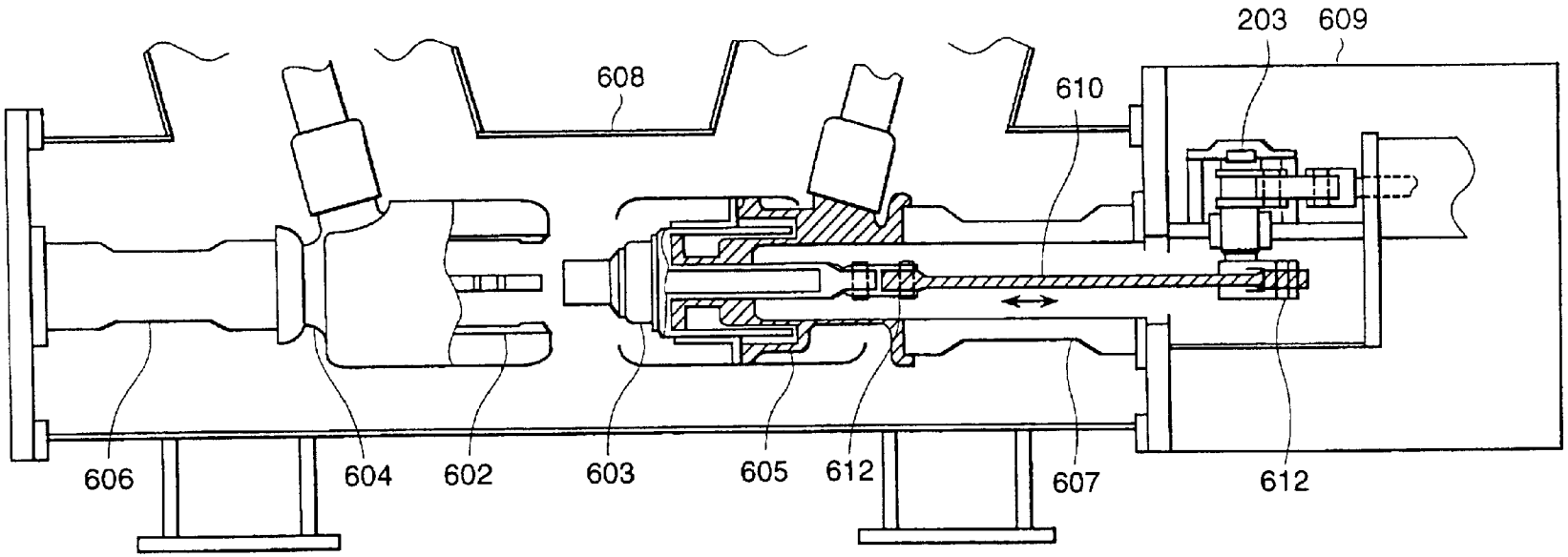
FIG. 6 is an explanatory diagram of an embodiment of the gas-insulated switch according to the present invention.

FIG. 6 shows a schematic construction of a preferred embodiment of the gas-insulated switch according to the present invention, wherein a fixed electrode 602 and a moving electrode 603, both constituting the breaking section of a circuit breaker, are connected to a fixed-side conductor 604 and a moving-side conductor 605, respectively. The fixed-side conductor 604 and moving-side conductor 605, supported respectively by the supporting insulators 606 and 607, are enclosed in a grounded vessel 608 filled with arc-extinguishing gas. The supporting insulator 607, moving-side conductor 605 and moving electrode 603 are supported by an operating mechanism box 609 which houses the operating mechanism, to be explained later. The moving electrode 603 is connected to the output lever 203 of the operating mechanism, to be explained later, via an insulated operating rod 610. The connection of the moving electrode 603, insulated operating rod 610 and operating mechanism section 611 is made with a pin 612 through each pinning hole in them.

As the operating mechanism, to be explained later, works according to a closing instruction, the output lever 203 moves and the force moves the insulated operating rod 610 so that, in the circuit closing operation, the moving electrode 603 is contacted with the fixed electrode 602 to close the circuit. In the circuit breaking operation, the output lever 203 moves in the reverse direction and accordingly the operating rod also moves in the reverse direction so that the moving electrode 603 is separated from the fixed electrode 602 to break the circuit.

Next, the operating mechanism of a preferred embodiment according to the present invention is explained hereunder.

Figure 1:
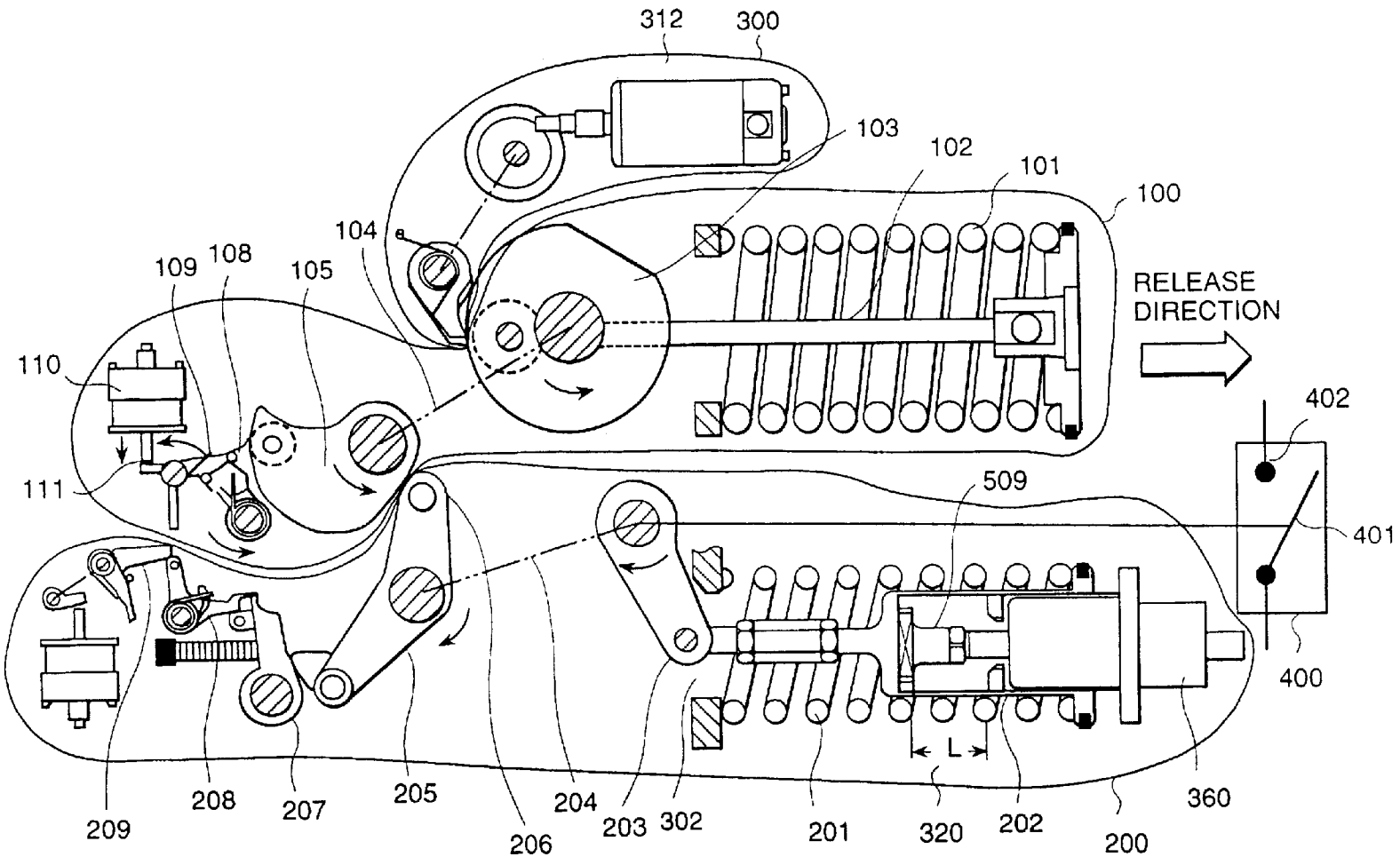
FIG. 1 is an explanatory diagram of the closing action of the gas-insulated switch using the spring operating device according to the present invention.

FIG. 1 shows the spring mechanism (the switch being in an open state) of the gas-insulated switch according to the present invention, and the construction and operation of the spring mechanism are explained hereunder.

The spring mechanism, which functions to contact and separate the moving contact with/from the fixed contact of the gas-insulated switch with the aid of a closing spring and a breaking spring, consists roughly of a closing operation section 100, breaking operation section 200 and closing-spring compression mechanism 300, and is further equipped with a shock absorber 360 in this embodiment.

In a normal operating condition of the switch, the mechanism is so designed that the closing spring 101 is always kept in a compressed state and the trigger hook 109 for retaining the closing operation section is in an engagement to retain the compression energy of the closing spring 101. The closing spring 101 is once released in the closing action but resumes a compressed state by the compression mechanism 300. In the compression mechanism 300, the closing spring 101 is gradually compressed as one claw of the ratchet gear is fed after another by the revolution of a closing spring compression motor 312 and, when compression is complete, the closing latch is set finally and the spring gets ready for the closing action. The mechanism is also so designed that the breaking spring 201, which is also in a compressed state as is the closing spring while the switch is in operation, is released once the switch breaks but compressed again in the next closing action and that, when compression is complete, the breaking trigger hook 209 is engaged and the compression energy of the breaking spring 201 is retained. Besides, the shock absorber 360 consists mainly of a piston, rod end and breaking spring guide.

An operation for switching from an open state to a close state is explained hereunder. The closing spring 101 is kept in a compressed state by the compression mechanism 300, the breaking spring 201 is in a released state, and the moving contact 401 of a circuit breaker 400 is at the open position apart from the fixed contact 402. The spring force of the closing spring 101 is transmitted to a cam 105 via the connecting shaft 104 of the closing operation section and the moment of counterclockwise (CCW) rotation of the cam 105 is retained by a closing catch lever 108. In addition, the moment of CCW rotation of the closing catch lever 108 generated by the cam 105 is retained by the closing trigger hook 109 to maintain the balance of force. When a closing solenoid 110 is energized according to a closing instruction of the circuit breaker 400 under this condition, a closing plunger 111 rotates the closing trigger hook 109 CCW so as to disengage the closing trigger hook 109 from the closing catch lever 108 and, at the same time, the closing catch lever 108 is disengaged from the cam 105, and then a gear 103, to which the closing spring force is transmitted via a closing spring link 102, rotates CCW and the closing spring 101 moves towards the right. The cam 105 also rotates CCW in linkage with the gear 103. As a result, a main transfer lever 205 in close contact with the periphery of the cam 105 is rotated clockwise (CW) by a main transfer lever roller 206 installed on the main transfer lever 205. As the output lever 203 is rotated CW, in linkage with this motion, via the connecting shaft 204 of the breaking operation section, the breaking spring in a released state is compressed by the force of the output lever 203 via the breaking spring link 302 connected to the output lever, and, at the same time, the main transfer lever 205 connected to the output lever 203 via the connecting shaft 204 of the breaking operation section is engaged with the breaking catch lever 207, the breaking catch lever 207 is engaged with a breaking intermediate lever 208, and finally the breaking intermediate lever 208 is engaged with the breaking trigger hook 209, thus retaining the breaking spring 201 in a close state which is a compressed state.

Besides, in the operating mechanism of the gas-insulated switch according to a preferred embodiment of the present invention, the shock absorber 360 used in both closing and breaking operations is installed, via a linkage, at a position in either of the moving directions of the output lever 203.

Figure 2:
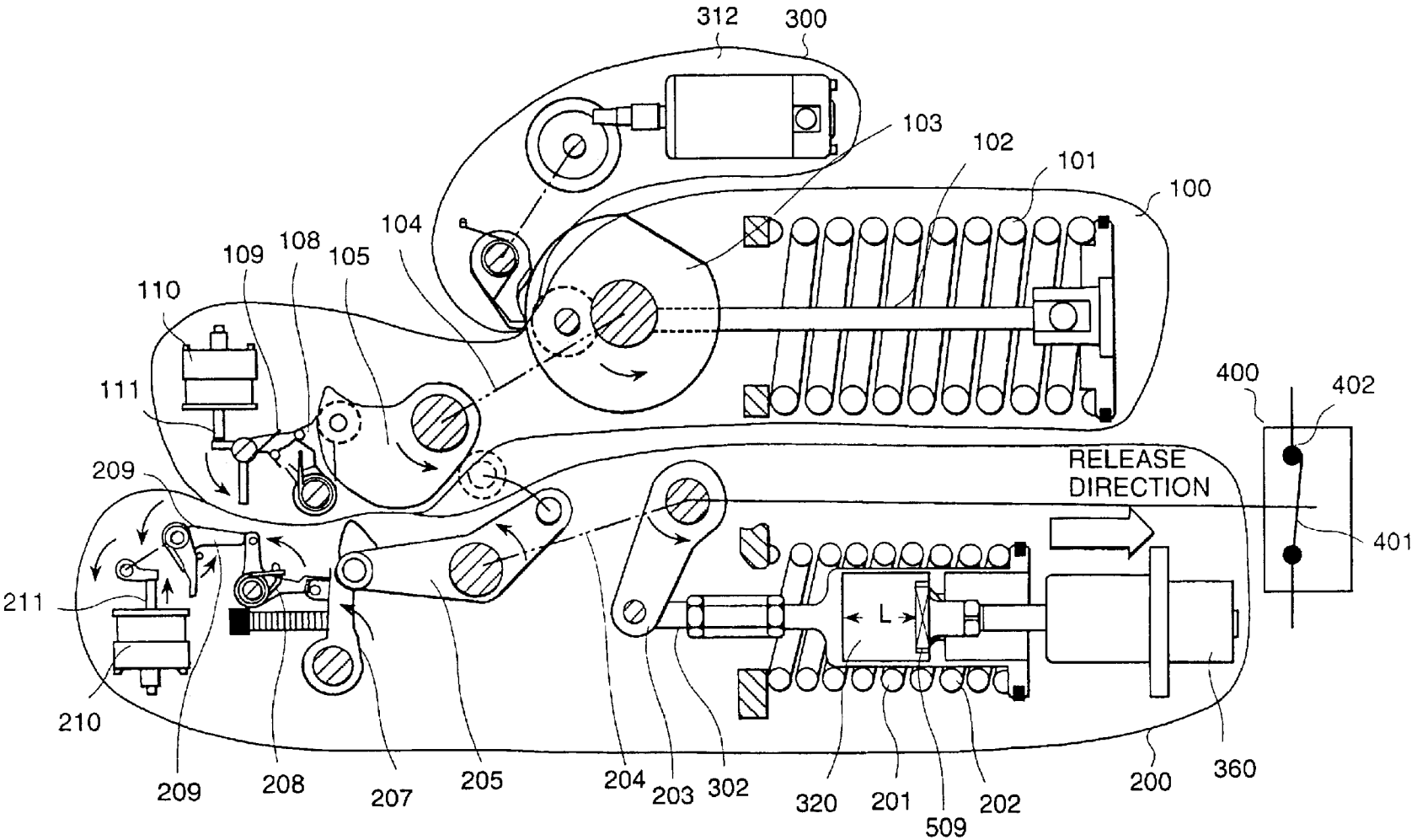
FIG. 2 is an explanatory diagram of the breaking action of the gas-insulated switch using the spring operating device according to the present invention.

At the last moment of the afore-mentioned closing action, a breaking spring guide 202, after moving in a free running distance of the design length L (320), strikes against the rod end 509 of the shock absorber 360 so as to brake the speed of the moving parts and the moving contact 401 gets in contact with the fixed contact 402 as shown in FIG. 2, causing the switch to be in a close state. After the closing action is complete, the closing spring 101 is compressed again by the closing spring compression mechanism 300, the spring force is transmitted to the gear 103 via the closing spring link 102 and then to the cam 105 via the connecting shaft 104 of the closing operating section, and the moment is retained by the closing catch lever 108 and closing trigger hook 109 to maintain the balance of force.

FIG. 2, which is a conceptual diagram of the operating device mechanism of a preferred embodiment of the gas-insulated switch according to the present invention, shows an operation for switching from a close state to an open state. The breaking spring 201, which is in a compressed state as a result of the action explained on FIG. 1, and the electrical moving contact 401 of the circuit breaker 400 is positioned in contact with the fixed contact 402, i.e. in a close state. The spring force of the breaking spring 201 is transmitted from the output lever 203 to the main transfer lever 205 via the connecting shaft 204 of the breaking operation section and the moment of CCW rotation of the main transfer lever 205 is retained by the breaking catch lever 207. In addition, the moment of CCW rotation of the breaking catch lever 207 generated by the moment of the main transfer lever 205 is retained by the breaking intermediate lever 208 and the moment of CCW rotation of the breaking intermediate lever 208 is retained by an engagement with the breaking trigger hook 209 to maintain the balance of force.

When a breaking solenoid 210 is energized according to a breaking instruction of the circuit breaker 400 under this condition, a breaking plunger 211 rotates the breaking trigger hook 209 CCW so as to disengage the breaking trigger hook 209 from the breaking intermediate lever 208 and, at the same time, the breaking catch lever 207 is disengaged from the main transfer lever 205, and then the output lever 203, to which the breaking spring force is transmitted via the breaking spring guide 202, rotates CCW and the breaking spring 201 moves towards the right.

At the last moment of the afore-mentioned breaking action, the breaking spring guide 202, after moving in a free running distance of the design length L (320), strikes against the rod end 509 of the shock absorber so as to brake the speed of the moving parts and the moving contact 401 separates from the fixed contact 402 as shown in FIG. 1, causing the switch to be in an open state.

Comparing the operating device of a preferred embodiment of the gas-insulated switch according to the present invention to the switch according to the prior art, a shock absorber needs to be provided individually for a closing operation and for a breaking operation in the prior art but, since the present invention realizes to perform shock absorption in both closing and breaking operations with a single shock absorber, the space needed for the operating device can be reduced.

In addition, since no loaded action is generated except in the shock absorbing action, the drive energy of the operating device needs not be consumed, resulting in improved energy efficiency.

Further, while the switch according to the prior art is generally equipped with a shock absorber for each closing operation and breaking operation and each shock absorber is installed at each CW and CCW position in the rotating directions of the output lever, the present invention realizes a construction that a single shock absorber for both closing and breaking operations is installed at a position in either of the rotating directions of the output lever and the construction achieves shock absorption in both closing and breaking operations, thus enabling to reduce the space needed for components as compared to the switch according to the prior art.

Figure 3:
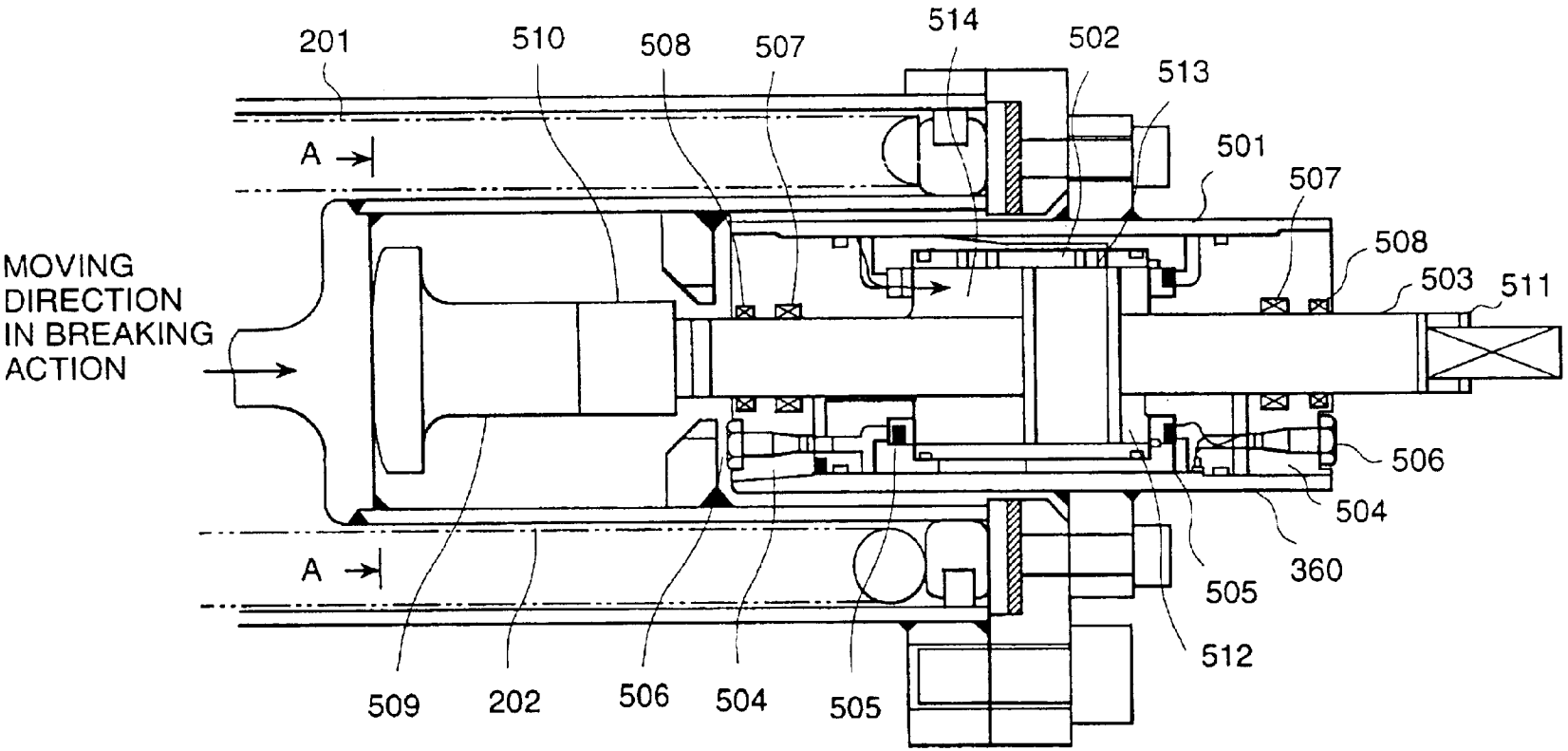
FIG. 3 is a detailed diagram of the shock absorber for the operating device of an embodiment of the gas-insulated switch according to the present invention.

FIG. 3 shows the detailed construction and operation of the shock absorber 360 employed for a preferred embodiment of the gas-insulated switch according to the present invention. The shock absorber of the embodiment comprises an outer tube 501, inner tube 502, piston 503, piston guide 504, check valve 505, adjusting throttle 506, high-pressure packing 507, dust seal 508, rod end 509, lock nut 510, and piston anti-rotation guide 511.

A preferred embodiment of the present invention in FIG. 3 shows an application where the shock absorber is installed inside the breaking spring guide 202. Since the shock absorber is installed inside the breaking spring 201, which is positioned opposite to the rotating direction of the output lever 203, no special space is needed for the shock absorber and, therefore, the operating device can be made compact.

The breaking spring guide 202 moves towards the right at the time of an instant circuit breaking operation. While the breaking spring guide 202 is moving in the design length L (320) after its start, the guide is not in contact with the rod end 509 of the shock absorber but is moving freely, causing no driving energy loss of the shock absorber. After the two strike against each other, the piston 503 also moves towards the right and accordingly the pressure of the working fluid contained in a breaking fluid chamber 512 increases as it is pushed out through a hole 513 made in the inner tube 502 and through the adjusting throttle 506, and a reaction force generated by the pressure increase brakes the speed of the moving parts. The working fluid pushed out from the breaking fluid chamber 512 pushes to open the check valve 505 on the closing fluid chamber side and flows into an opening fluid chamber 514. When the moving distance of the piston reaches the design length, the hole made in the inner tube 502 becomes no longer available and the working fluid can flow only through the adjusting throttle 506. With this construction, it becomes possible to easily achieve the braking characteristic adjustment as an adjustment of the pressure increase characteristic in the liquid chamber by closing or opening the throttle 506 externally. Also in the closing action, as in the breaking action, the breakage is achieved as the rod end 509 and breaking spring guide 202 strike against each other after the movement in the free moving distance L (320), which is the design length, as shown in FIG. 1.

Figure 4A:
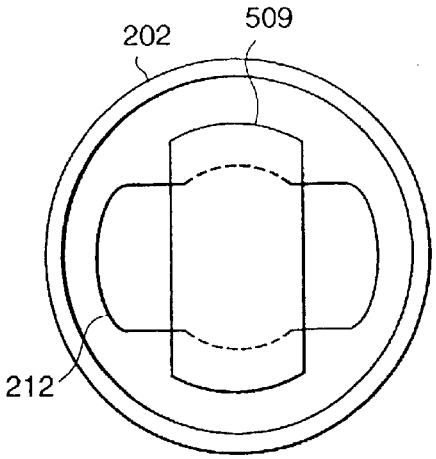
FIG. 4(*a*) is a view along line A—A of FIG. 3 showing the shock absorber in a final mounting position.
Figure 4B:
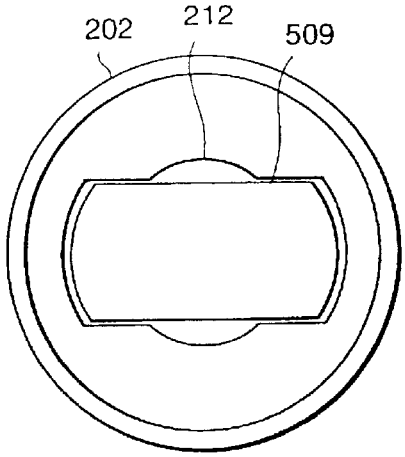
Figure 5:
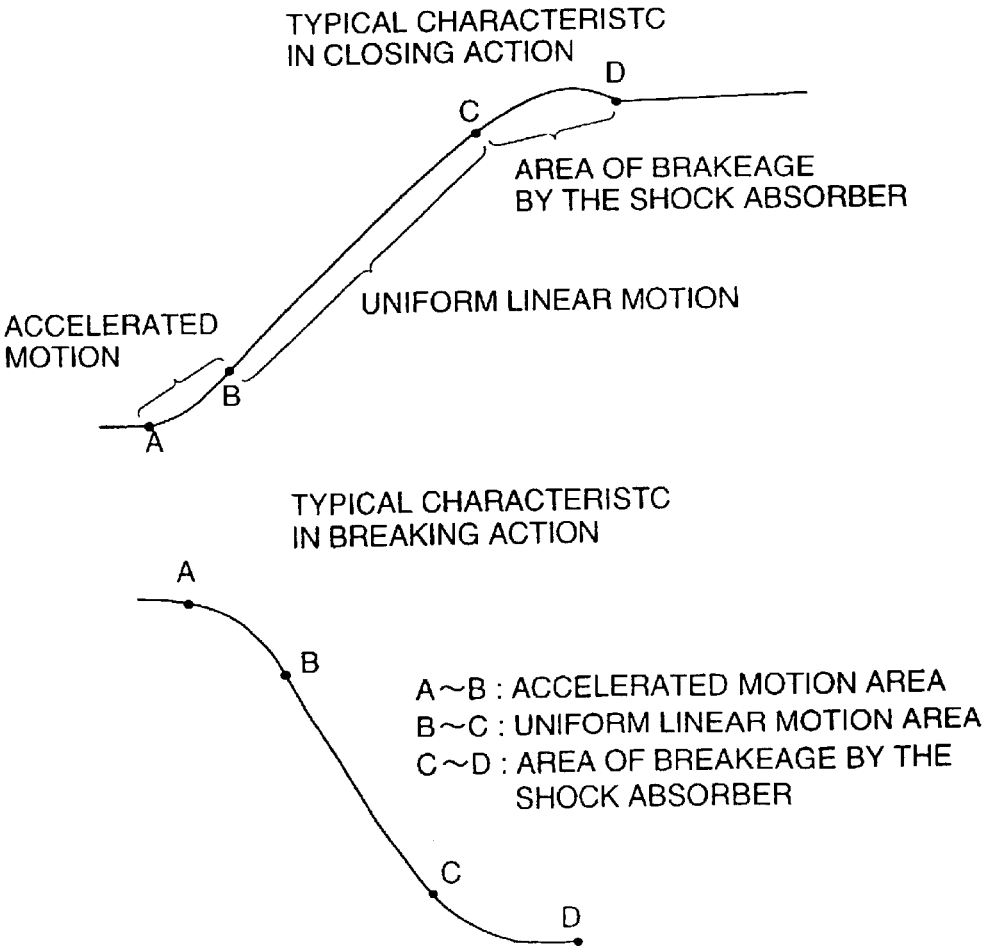
FIG. 5 is a closing and breaking motion characteristics diagram of the gas-insulated switch.

FIG. 4 shows the relationship between the rod end 509 and an oblong hole 212 made in the breaking spring guide 202 in the shock absorber 360 of a preferred embodiment according to the present invention. FIG. 4 (*a*) shows the shock absorber in its final mounting position, and FIG. 4 (*b*) shows the shock absorber in the course of being mounted.

The relationship between the striking portion of the rod end 509 and the breaking spring guide 202 is such that the longitudinal direction of the rod end 509 is positioned at 90 degrees from the oblong hole 212 made in the breaking spring guide 202 as shown in FIG. 4 (*a*). In mounting the shock absorber, the longitudinal direction of the rod end is first matched with and inserted into the oblong hole 212 made in the breaking spring guide 202 as shown in FIG. 4 (*b*), and then the rod is turned by 90 degrees and fastened. Thus, even when the breaking spring guide 202 moves towards the left in the closing action, the rod end 509 strikes against the breaking spring guide 202 and the breakage can also be achieved.

Use of the shock absorber as above in the operating device achieves both reducing the installation space of components as a result of minimizing the component size and improving the reliability as a result of reducing the number of parts and, at the same time, realizes adjusting the closing and breaking characteristics easily from the outside.

As explained above, with a preferred embodiment of the gas-insulated switch according to the present invention, the operating mechanism can be made compact and, accordingly, the overall construction of the operating mechanism box 609 can be made smaller than in the prior art.

Besides, with the gas-insulated switch according to the present invention, since the switch can be made compact as a whole, reducing the land area necessary for constructing a power station or substation is realized.

Additionally, although the embodiments explained above describe a vertically installed gas-insulated switch, the present invention is applicable to various types of switches including a horizontally installed gas-insulated switch.

As explained above, with the preferred embodiment of the gas-insulated switch according to the present invention, the energy needed to cause the moving parts to make accelerated motion and uniform motion can be lowered and, accordingly, it becomes possible to lower the specification requirement of a component such as a spring, pneumatic cylinder, or hydraulic cylinder, serving as the energy source of the operating device itself, used in the gas-insulated switch. As a result, the size of the operating device itself for driving the gas-insulated switch and the overall size of the gas-insulated switch can be reduced. At the same time, while, in the prior art, two shock absorbers need to be installed, each for the closing operation and for the breaking operation, in a mechanism where the shock absorber does not work as a continuous load, the present invention allows to construct the necessary shock absorbers into a single unit as explained in the preferred embodiments, thus enabling to further reduce the size of the operating device. As a result, it becomes possible to realize offering a gas-insulated switch that sufficiently meets the social needs such as effective utilization of the space of a power station or substation and improvement of the economy.

As a result that use of the shock absorber according to the present invention improves the overall energy efficiency of components, speaking from an electrical view point, an operating device with further reduced driving energy can be applied to a gas-insulated switch of the same specification, hence resulting in reduced component size and, at the same time, improved reliability due to reduced number of parts.

What is claimed is:

1. A gas-insulated switch having:

a breaking section comprising a fixed contact and a moving contact that enable to contact with and separate from said fixed contact, both of said fixed contact and said moving contact installed in a ground vessel filled with insulation gas;

an operating device comprising a closing operation section that closes said fixed contact and said moving contact of said breaking section and a breaking operation section that breaks said fixed contact and said moving contact; and a shock absorber that absorbs the shock on both of said fixed contact and said moving contact in a closing operation and a braking operation of said operating device; wherein said shock absorber comprises a piston, a rod end, and a breaking spring guide;

said shock absorber is installed in a breaking spring of said breaking operation section of said operating device; and said shock absorber absorbs the shock in both of said closing operation and said breaking operation.

2. A gas-insulated switch according to claim 1, wherein said operating device closes and breaks said fixed contact and said moving contact through an operating rod, and an operation direction of said operating rod is the same direction of an operating direction of said shock absorber.

* * * * *